US008532830B2

(12) United States Patent
Van Dijk

(10) Patent No.: US 8,532,830 B2
(45) Date of Patent: Sep. 10, 2013

(54) METHOD AND APPARATUS FOR CONTROLLING A COMPRESSOR AND METHOD OF COOLING A HYDROCARBON STREAM

(75) Inventor: Frederick Jan Van Dijk, Amsterdam (NL)

(73) Assignee: Shell Oil Company, Houston, TX (US)

( * ) Notice: Subject to any disclaimer, the term of this patent is extended or adjusted under 35 U.S.C. 154(b) by 343 days.

(21) Appl. No.: 13/056,198

(22) PCT Filed: Jul. 2, 2009

(86) PCT No.: PCT/EP2009/058317
§ 371 (c)(1),
(2), (4) Date: Jan. 27, 2011

(87) PCT Pub. No.: WO2010/012559
PCT Pub. Date: Feb. 4, 2010

(65) Prior Publication Data

US 2011/0130883 A1 Jun. 2, 2011

(30) Foreign Application Priority Data

Jul. 29, 2008 (EP) ..... 08161338

(51) Int. Cl.
*G05D 11/00* (2006.01)

(52) U.S. Cl.
USPC ..... 700/282

(58) Field of Classification Search
USPC ..... 700/282
See application file for complete search history.

(56) References Cited

U.S. PATENT DOCUMENTS 4,156,578 A 5/1979 Agar et al. ..... 415/1
4,464,720 A 8/1984 Agarwal ..... 364/431.02

(Continued)

FOREIGN PATENT DOCUMENTS

EP 1031803 8/2000
EP 1031803 A2 * 8/2000

(Continued)

OTHER PUBLICATIONS

Jamaludin S: "Process understanding and control approach of separator column coupled with overhead compressor: lessons learnt from Malaysia LNG Tiga" Jan. 1, 2005, AICHE Spring Meeting. Natural Gas Utilization Conference, X, US, pp. 271-280, XP009097533.

(Continued)

*Primary Examiner* — Mohammad Ali
*Assistant Examiner* — Sivalingam Sivanesan

(57) ABSTRACT

Method and apparatus for controlling one or more first compressors (12), through which a compressor feed stream (10) is passed. At least one throttling valve (32) is provided downstream of a compressor recycle line (22), which is provided around the or each first compressor (12) and includes an in-line first recycle valve (24). Sometimes, at least a fraction of the compressor feed stream (10) is selectively allowed to bypass the or each first compressor (12) and the at least one throttling valve, via a bypass line (60). At least one of the throttling valves (32) is automatically controlled using the measurement values of at least one pressure and at least one flow of the group consisting of: the pressure (P1) of the compressor feed stream (10), the flow (F1) of the compressor feed stream (10), the pressure (P2) of the first compressed stream (20) and the flow (F2) of the first compressed stream (20). A first compressor controlled this way may be used in a method of cooling an initial hydrocarbon stream (100).

18 Claims, 5 Drawing Sheets

(56) References Cited

U.S. PATENT DOCUMENTS

| | | | | |
|---|---|---|---|---|
| 4,526,513 | A | 7/1985 | Bogel | 417/5 |
| 4,809,154 | A * | 2/1989 | Newton | 700/28 |
| 4,949,276 | A * | 8/1990 | Staroselsky et al. | 700/282 |
| 5,743,714 | A | 4/1998 | Drob | 417/2 |
| 5,743,715 | A | 4/1998 | Staroselsky et al. | 417/6 |
| 6,332,336 | B1 * | 12/2001 | Mirsky et al. | 62/613 |
| 6,401,486 | B1 | 6/2002 | Lee et al. | 62/630 |
| 2006/0218936 | A1 | 10/2006 | Kobayashi et al. | 62/3.1 |
| 2007/0193303 | A1 | 8/2007 | Hawrysz et al. | 62/612 |

FOREIGN PATENT DOCUMENTS

| | | |
|---|---|---|
| WO | WO 9931448 A1 * | 6/1999 |
| WO | WO0188447 | 11/2001 |
| WO | WO 0188447 A1 * | 11/2001 |
| WO | WO2007110331 | 10/2007 |
| WO | WO2010012560 | 2/2010 |

OTHER PUBLICATIONS

Zeckendorf A et al: "Design, Simulation Create Low Surge, Low Cost Gas-Injection Compressor," Oil and Gas Journal, Pennwell, Houston, TX, US, vol. 93, No. 3, Jan. 16, 1995, pp. 57-62, XP000504358, ISSN: 0030-1388, * figure 3a *.

Comparison on Type Selection of Main Air Blower in Catalytic Cranking Unit, Wang Ziqui, on pp. 41-43 of period 3 of Petro-Chemical Equipment Technology, published Jun. 30, 2004. (This reference was cited in an Office Action issued by the Chinese Patent Office on Jan. 30, 2013 in related Chinese Application for Invention No. 200980128620.0).

* cited by examiner

METHOD AND APPARATUS FOR CONTROLLING A COMPRESSOR AND METHOD OF COOLING A HYDROCARBON STREAM

CROSS REFERENCE TO EARLIER APPLICATIONS

The present application is a national stage application of International application No. PCT/EP2009/058317, filed 2 Jul. 2009, which claims priority of EP08161338.2 filed in the European patent office on 29 Jul. 2008.

FIELD OF THE INVENTION

The present invention relates to a method and apparatus for controlling a compressor. In another aspect, the invention relates to a method of cooling a hydrocarbon stream.

BACKGROUND OF THE INVENTION

Natural gas is a useful fuel source, as well as being a source of various hydrocarbon compounds. It is often desirable to liquefy natural gas in a liquefied natural gas (LNG) plant at or near the source of a natural gas stream for a number of reasons. As an example, natural gas can be stored and transported over long distances more readily as a liquid than in gaseous form because it occupies a small volume and does not need to be stored at high pressure.

Usually, natural gas comprises predominantly methane. In addition to methane, natural gas usually includes some heavier hydrocarbons such as ethane, propane, butanes, $C_5$+ hydrocarbons and aromatic hydrocarbons. These and any other common or known heavier hydrocarbons and impurities either prevent or hinder the usual known methods of liquefying the methane, especially the most efficient methods of liquefying methane. Most if not all known or proposed methods of liquefying hydrocarbons, especially liquefying natural gas, are based on reducing as far as possible the levels of at least most of the heavier hydrocarbons and impurities prior to the liquefying process.

Hydrocarbons heavier than methane and usually ethane are typically condensed and recovered as natural gas liquids (NGL) from a natural gas stream, generally termed NGL recovery. The NGLs are usually fractionated to yield valuable hydrocarbon products, either as products steams per se or for use in liquefaction, for example as a component of a refrigerant.

NGL recovery generally involves an NGL separation column in which the natural gas stream is separated into a bottom stream containing the NGLs and a methane-enriched overhead stream, which is often compressed or recompressed (the natural gas stream may have been depressurized upstream of the NGL separation column) by one or more compressors.

Compressors for gaseous streams are used in many situations, systems and arrangements. Usually there is a vapour recycle or recirculation line around the compressor to avoid 'surge'. Normally, surge is related to a flow to the compressor being too low, which can cause rapid pulsations in flow.

U.S. Pat. No. 4,464,720 discloses a surge control system which utilizes an algorithm to calculate a desired orifice differential pressure, and which compares the calculated result with an actual differential pressure. Pressure and temperature measurements are made on both the suction side and discharge side of a centrifugal compressor, and thus enter a control system so that the actual differential pressure is substantially equal to the desired differential pressure. A suction temperature of gas entering the centrifugal compressor is measured and used.

However, even with a surge control system damage can occur and the compressor can fail.

SUMMARY OF THE INVENTION

The present invention provides in a first aspect a method of controlling one or more first compressors at least comprising the steps of:

(a) providing a compressor feed stream;

(b) passing the compressor feed stream through the one or more first compressors, the or each first compressor having a first inlet and a first outlet to provide one or more first compressed streams;

(c) measuring at least one pressure and at least one flow of the group consisting of: the pressure of the compressor feed stream, the flow of the compressor feed stream, the pressure of the first compressed stream and the flow of the first compressed stream, to provide at least two measurement values;

(d) providing a first compressor recycle line including an in-line first recycle valve around the or each first compressor;

(e) passing the or each first compressed stream through at least one throttling valve downstream of the compressor recycle line to provide a controlled stream;

(f) selectively allowing a fraction of the or each compressor feed stream to bypass the or each first compressor and the at least one throttling valve (32) via a first bypass line; and (g) automatically controlling at least one of the throttling valve(s) using the measurement values of step (c).

In a second aspect, the invention provides a method of cooling an initial hydrocarbon stream, preferably containing natural gas, comprising at least the steps of:

(i) passing the initial hydrocarbon stream through a separator to provide a stabilized condensate stream and a mixed hydrocarbon stream;

(ii) separating the mixed hydrocarbon stream into a light overhead stream as a compressor feed stream, and a heavy bottom stream; and (iii) passing the compressor feed stream through one or more first compressors and at least one throttling valve, and controlling the one or more first compressors using a method as defined in the method of the first aspect set of the invention as forth above, to provide one or more controlled streams;

(iv) passing the or each controlled stream through one or more second compressors to provide one or more second compressed streams; and (v) cooling, preferably liquefying, at least a fraction of the one or more second compressed streams to provide a cooled, preferably liquefied, hydrocarbon stream.

The invention further provides an apparatus for controlling one or more first compressors, the apparatus at least comprising:

one or more first compressors to compress a compressor feed stream between a first inlet and a first outlet in the or each first compressor to provide one or more first compressed streams;

at least two measurers able to measure at least one pressure and at least one flow of the group consisting of: the pressure of the compressor feed stream, the flow of the compressor feed stream, the pressure of the first compressed stream and the flow of the first compressed stream; to provide at least two measurement values;

a compressor recycle line including an in-line first recycle valve around the or each first compressor;

at least one throttling valve downstream of the compressor recycle line to received the or each first compressed stream to provide a controlled stream;

a first bypass line to allow a fraction of the compressor feed stream to bypass the or each first compressor and the at least one throttling valve; and automatically controlling at least one of the throttling valves using the measurements values of step (c).

This apparatus may form part of a natural gas liquefaction plant or facility.

BRIEF DESCRIPTION OF THE DRAWINGS

Embodiments and examples of the present invention will now be described by way of example only with reference to the accompanying non-limited drawings in which.

Figure 1:
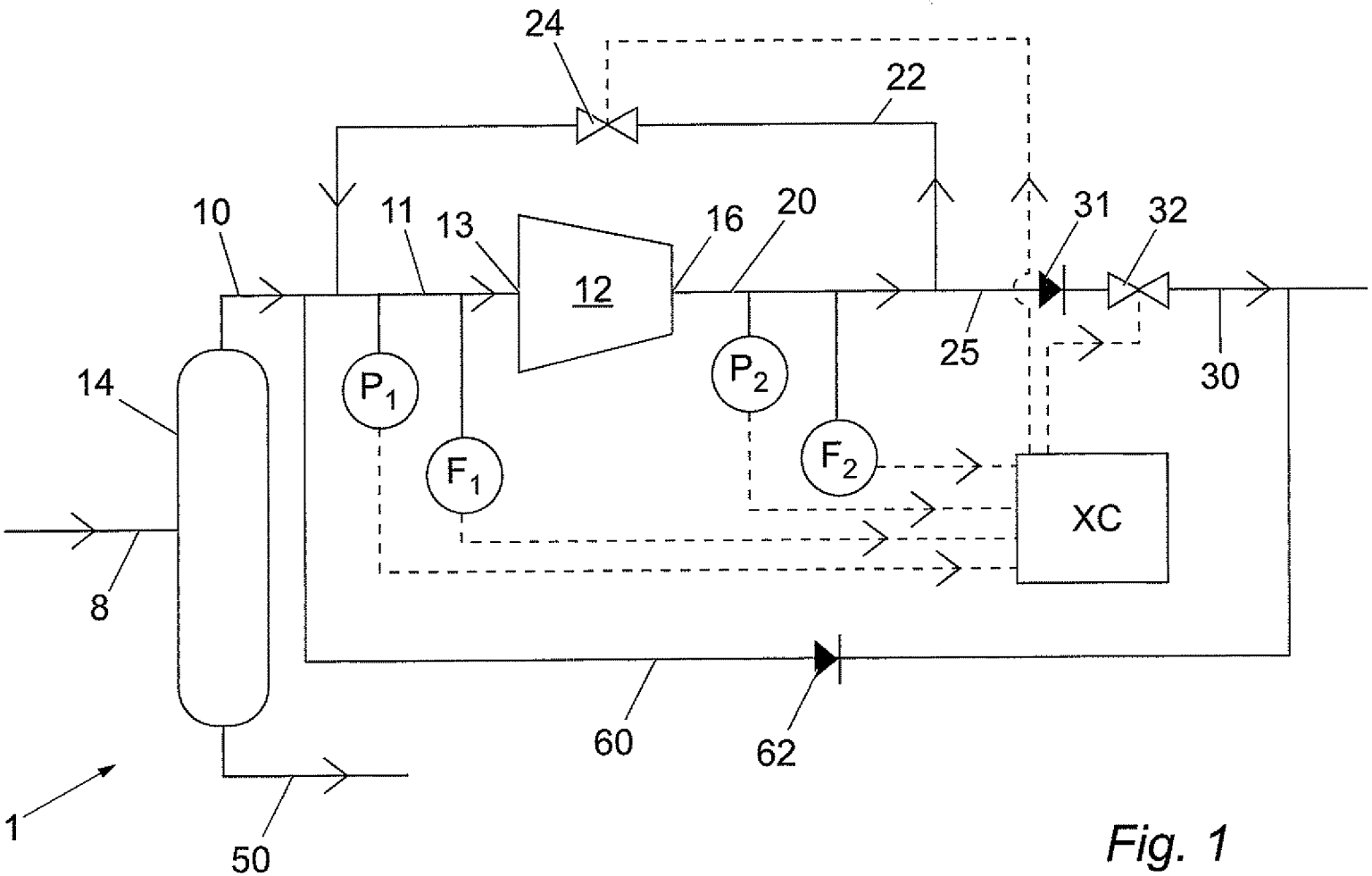
FIG. 1 is a diagrammatic scheme for a method of controlling a compressor according to one embodiment of the present invention.

For the purpose of this description, a single reference number will be assigned to a line as well as a stream carried in that line, and a single reference will be assigned to a pressure/flow of a stream as well as to a measurer of that pressure/flow.

DETAILED DESCRIPTION OF THE INVENTION

It has been found that automatically controlling a throttling valve provided downstream of a compressor using measurement values of at least one pressure of the group consisting of: pressure of the compressor feed stream and pressure of the first compressed stream; and one flow of the group consisting of: flow of the compressor feed stream and flow of the first compressed stream; allows to prevent choking from occurring. Other than surge, a compressor may also be damaged by 'stonewall' or choking. Thus, herewith failure and/or damage to the compressor is reduced.

Choking of a compressor occurs when there is overcapacity of flow at too low a pressure ratio, so that the compressor 'chokes' and is unable to compress the flow of the gas. This causes high vibration which may damage the compressor.

The problem of choking can be avoided by the method disclosed herein in which the throttling valve downstream of the compressor is automatically controlled to let down the pressure of the first compressed stream and automatically regulate the pressure of the first compressed stream relative to the pressure of the bypass line. In this way, moving into an operating condition where choking occurs can be avoided.

Compressor surge is a phenomenon which occurs in compressors at low volumetric flow rates, and hence limits the minimum capacity of a given compressor. In the operation of a compressor, as the system resistance is increased, the head or compression ratio generated by the compressor increases to overcome this resistance. As the system pressure increases, less flow can pass through the compressor, and this will continue up to the maximum head capacity of the compressor. Limits in the minimum flow form a surge line. Below the surge line the back pressure exceeds that which the compressor is capable of delivering, causing a momentary backflow condition. During backflow the system resistance decreases, causing the back pressure to drop, enabling the compressor to deliver increased flow. If the opposition to flow downstream of the compressor is unchanged, peak head delivery will again be approached and backflow observed, producing a cyclic condition known as surge. Considerable damage can be done to a compressor if it is operated beyond the surge point due to vibration, noise, axial shaft movement and overheating which can produce mechanical damage.

The problem of surge can be avoided by the method disclosed herein by automatically controlling the in-line first recycle valve to open and increase the quantity of first compressed stream which is returned to the compressor feed stream along the first compressor recycle line, when the surge line is approached.

The present embodiment provides a more efficient method of controlling a compressor based on automatically controlling a downstream throttling valve, which allows control and integration of the compressor in a line-up or system for processing a hydrocarbon stream, for example during start-up and build up of the flow and pressure of the compressor feed stream, or due to any upstream pressure drop. The automation of the control of the compressor enables the determination of the current operating point under which the compressor is operating relative to an acceptable operating window for the compressor by measuring compressor data. The automation of the controller thus allows the operation of the compressor to be altered to reduce the likelihood of compressor problems such as compressor surge and choke.

The controlling of the first compressor(s) using the automatic controlling of a downstream throttling valve as described herein, and the apparatus therefore, are of particular usefulness for starting-up of a first compressor.

Figure 2:
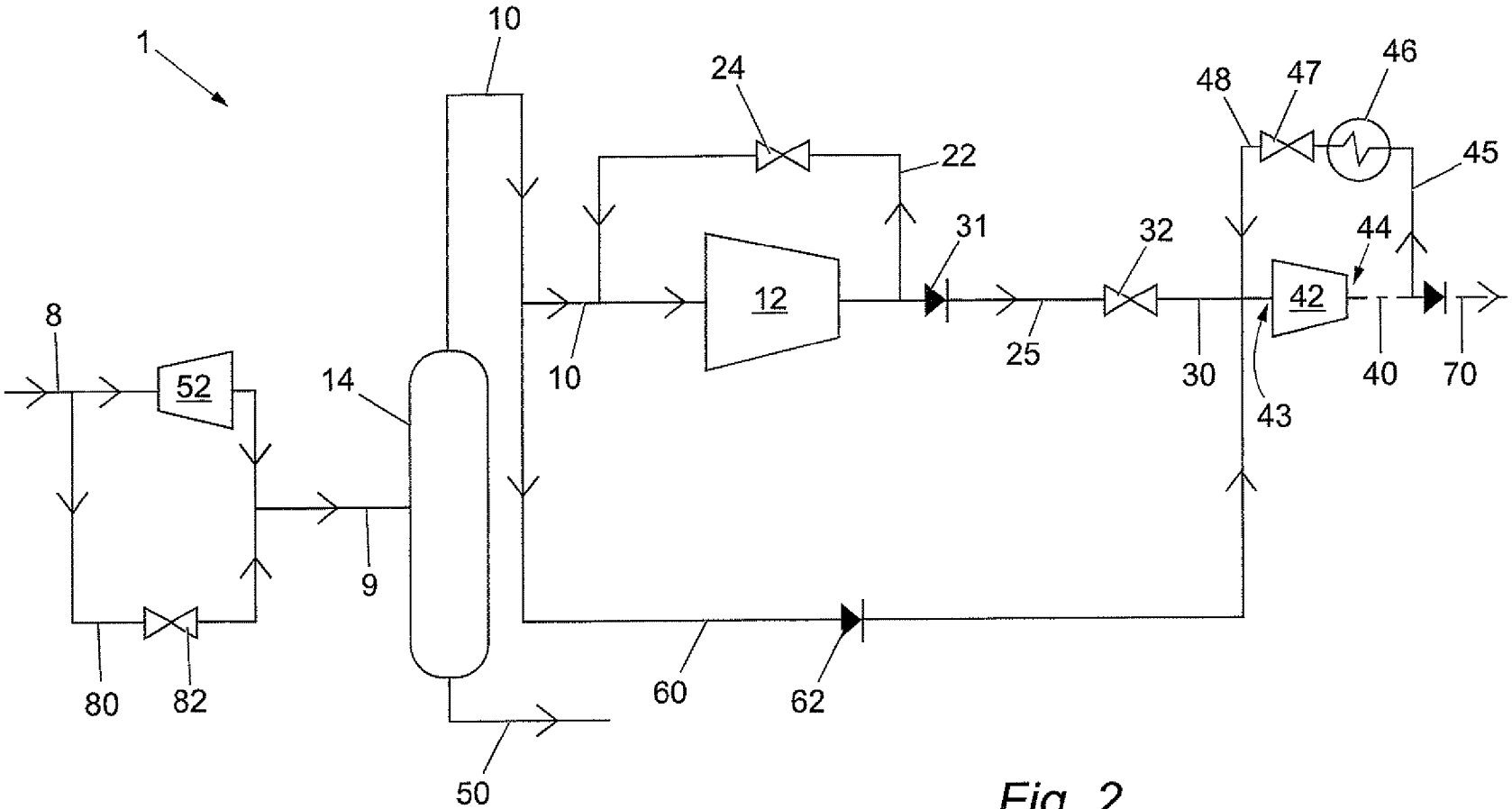
FIG. 2 is a diagrammatic scheme for a method of controlling a compressor according to a second embodiment of the present invention.
Figure 3:
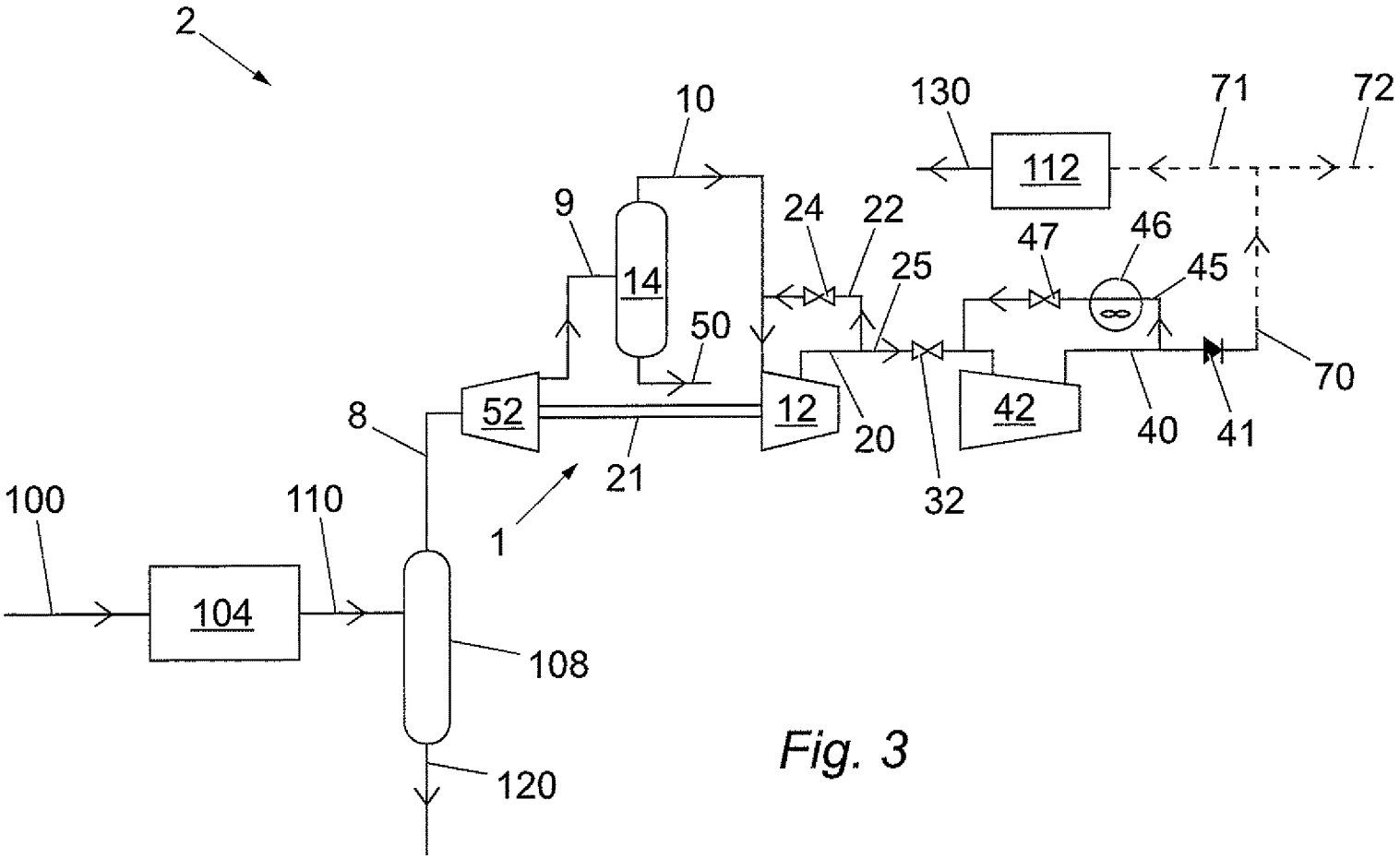
FIG. 3 is a diagrammatic scheme of a method of cooling an initial hydrocarbon stream including embodiments shown in FIGS. 1 and 2.

Referring to the drawings, FIGS. 1 and 2 show various embodiments of methods for controlling a first compressor 12 for compressing a compressor feed stream 10 as part of an NGL recovery system 1. FIG. 3 shows a simplified and first general scheme of a liquefied natural gas plant 2 for a method for cooling an initial hydrocarbon stream 100, including the NGL recovery system 1 of FIGS. 1 and 2.

An initial hydrocarbon stream may be any suitable hydrocarbon stream such as, but not limited to, a hydrocarbon-containing gas stream able to be cooled. One example is a natural gas stream obtained from a natural gas or petroleum reservoir. As an alternative, the natural gas stream may also be obtained from another source, also including a synthetic source such as a Fischer-Tropsch process.

Usually such an initial hydrocarbon stream is comprised substantially of methane. Preferably such an initial hydrocarbon stream comprises at least 50 mol % methane, more preferably at least 80 mol % methane.

FIG. 3 shows an initial hydrocarbon stream 100 containing natural gas, which is cooled by a first cooling stage 104 to provide a cooled and partly condensed initial hydrocarbon stream 110.

The first cooling stage 104 may comprise one or more heat exchangers either in parallel, series or both, in a manner known in the art. The provision of cooling to the first stage cooling 104 is known to the person skilled in the art. The cooling of the initial hydrocarbon stream 100 may be part of a liquefaction process, such as a pre-cooling stage involving a propane refrigerant circuit (not shown), or a separate process. Cooling of the initial hydrocarbon stream 100 may involve reducing the temperature of the initial hydrocarbon stream 100 to below −0° C., for example, in the range −10° C. to −70° C.

The cooled initial hydrocarbon stream 110 can be passed into a separator such as a condensate stabilisation column 108, usually operating at an above ambient pressure in a manner known in the art. The condensate stabilisation column 108 provides an overhead mixed hydrocarbon stream 8, preferably having a temperature below −0° C., and a stabilized condensate stream 120. The overhead stream 8 is an enriched-methane stream compared to the cooled initial hydrocarbon stream 110.

The term "mixed hydrocarbon stream" as used herein relates to a stream comprising methane ($C_1$) and at least 5 mol % of one or more hydrocarbons selected from the group comprising: ethane ($C_2$), propane ($C_3$), butanes ($C_4$), and $C_5$+ hydrocarbons. Typically, the proportion of methane in the mixed hydrocarbon stream 8 is 30-50 mol %, with significant fractions of ethane and propane, such as 5-10 mol % each.

The terms "light" and "heavy" are defined relative to each other, and make reference to the overhead stream respectively the bottom stream from the one or more gas liquid separators 14. The composition of the "light" and "heavy" hydrocarbon streams depends on the composition of the feed gas as well as on the design and operation conditions of the gas liquid separators.

The term "heavy hydrocarbon stream" relates to a stream comprising a relatively higher content of heavier hydrocarbons than the light overhead stream. For instance, the heavy hydrocarbon stream could be a $C_2$+ hydrocarbon stream, which predominantly comprises ethane ($C_2$) and heavier hydrocarbons. The relative amount of ethane is higher than the relative amount of ethane in the feed stream, but a $C_2$+ stream could still comprise some methane. Likewise, a $C_3$+ hydrocarbon stream, a $C_4$+ hydrocarbon stream or a $C_5$+ hydrocarbon stream is relatively rich in propane and heavier, butanes and heavier, or, respectively, pentanes and heavier.

In NGL recovery, it is desired to separate a methane enriched stream from a mixed hydrocarbon stream (for example, for use as a fuel, or to be liquefied in the LNG plant 2 and provided as additional LNG), and to recover at least a heavy stream, optionally one or more of a $C_2$ stream, a $C_3$ stream, a $C_4$ stream, and a $C_5$+ stream.

In FIG. 3, at least a fraction, usually all, of the mixed hydrocarbon stream 8 passes into the NGL recovery system 1. The NGL recovery system 1 usually involves one or more gas/liquid separators such as distillation columns and/or scrub columns to separate the mixed hydrocarbon stream 8 into at least a light stream and one or more heavy streams at a relatively low pressure, for example in the range of 20 to 35 bar. An example of a suitable first gas/liquid separator 14 is a "demethanizer" designed to provide a methane-enriched overhead stream, and one or more liquid streams at or near the bottom enriched in $C_2$+ hydrocarbons. However, depending on composition of the mixed hydrocarbon feed stream and the desired specification of the light overhead stream, the first gas/liquid separator 14 may be a de-ethanizer, a de-propanizer, or a de-butanizer or a scrub column, instead of a de-methanizer.

As the mixed hydrocarbon stream 8 is usually provided from a high pressure initial hydrocarbon stream 100, for example in the range of 40 to 70 bar, it may need to be expanded prior to the first gas/liquid separator 14. Such expansion may also cause a reduction in the temperature. As shown in FIGS. 2 and 3, the mixed hydrocarbon stream 8 can pass through one or more expanders 52 to provide a reduced temperature and pressure mixed-phase (liquid and vapour) hydrocarbon stream 9, which then enters the first gas/liquid separator 14 at a suitable height.

The first gas/liquid separator 14 is adapted to separate the liquid and vapour phases, so as to provide a light overhead stream (as the first compressor stream 10 subsequently used herein), and a heavy bottom stream 50. The first gas/liquid separator 14 may include a reboiler and a first reboiler vapour return stream (not shown) in a manner known in the art.

The nature of the streams provided by the first gas/liquid separator 14 can be varied according to the size and type of separator, and its operating conditions and parameters, in a manner known in the art. For the arrangement shown in FIGS. 1-3, it is desired for the light overhead controlled stream 30 to be methane-enriched. The light overhead stream may still comprise a minor (<10 mol %) amount of heavy hydrocarbons, but is preferably >80 mol %, more preferably >95 mol % methane. The heavy bottom stream 50 can be >90 or >95 mol % ethane and heavier hydrocarbons, and can be subsequently fractionated or otherwise used in a manner known in the art for an NGL stream.

The light overhead stream provides one possible source of a compressor feed stream 10, can now be (re)compressed for subsequent use by at least one or more first compressors 12.

FIG. 1 shows one embodiment of the method disclosed herein comprising:

(a) providing the compressor feed stream 10;

(b) passing the compressor feed stream 10 through the first compressor 12 having a first inlet 13 and a first outlet 16 to provide a first compressed stream 20;

(c) measuring at least one pressure and at least one flow of the group comprising: the pressure P1 of the compressor feed stream 10, the flow F1 of the compressor feed stream 10, the pressure P2 of the first compressed stream 20 and the flow F2 of the first compressed stream 20; to provide at least two measurement values;

(d) providing a compressor recycle line 22 including an in-line first recycle valve 24 around the first compressor 12;

(e) passing the first compressed stream 20 through at least one throttling valve 32 downstream of the compressor recycle line 22 to provide a controlled stream 30;

(f) providing a first bypass line 60 to selectively allow a fraction of the compressor feed stream 10 to bypass the first compressor and the throttling valve 32; and (g) automatically controlling at least one of the throttling valves 32 using the measurements values of step (c).

Choking of a compressor occurs when there is overcapacity of flow at too low a pressure ratio, so that the compressor 'chokes' and is unable to compress the flow of gas. This causes high vibration which may damage the compressor. The problem of avoiding choking as well as surge in a compressor is not mentioned in U.S. Pat. No. 4,464,720.

The selection and/or combination of the pressure and flow measurements taken from the compressor feed stream 10 and/or of the first compressed stream 20 in the presently disclosed embodiment, can be used to determine the operation of the first compressor 12 relative to its choke line.

Figure 4:
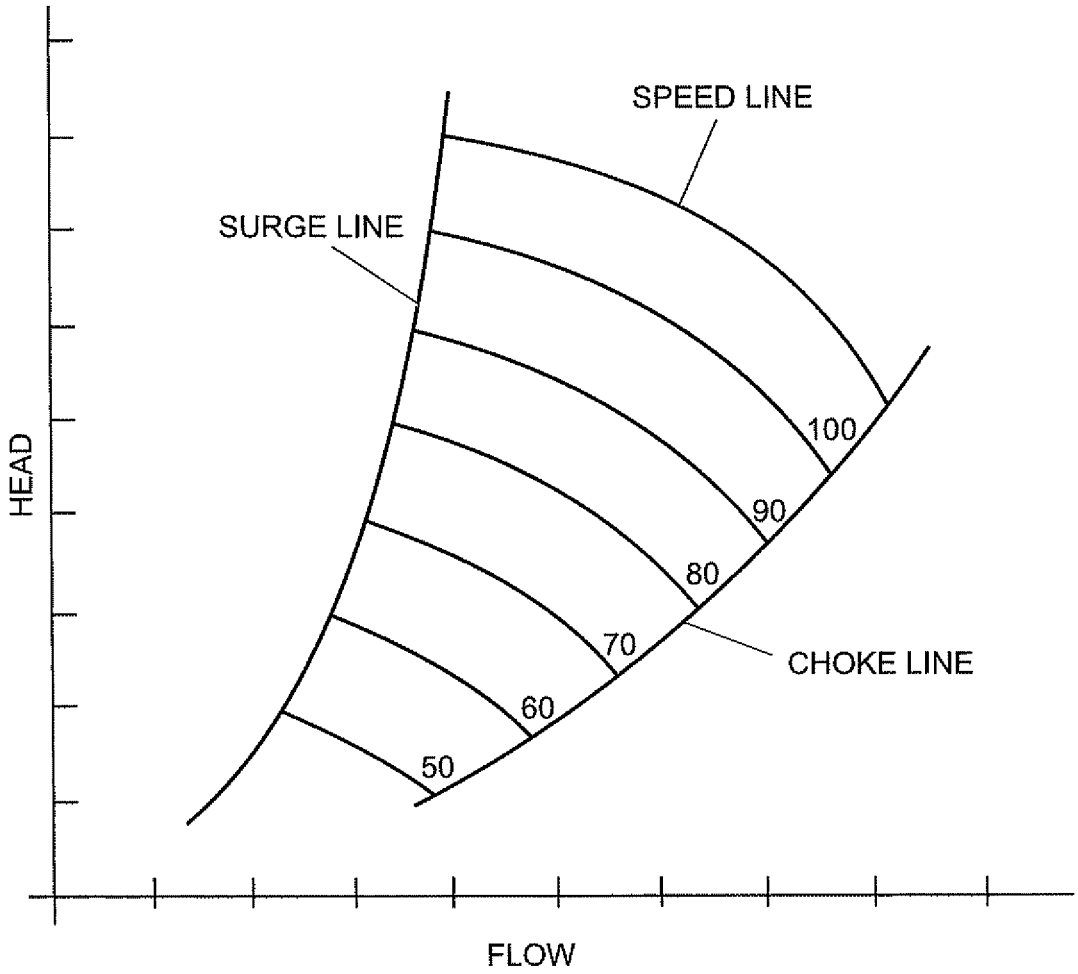
FIG. 4 is an exemplary plot of head compression ratio versus capacity for a compressor, showing surge, speed and choke lines.

The choke line of a compressor is known to the user of the compressor, and is usually a property of a compressor which is part of the compressor design parameters. The characteristic curves of a compressor, based on the comparisons of the head against the compressor inlet volume flow at different gas conditions (e.g. temperature and molecular weight), are parameters provided by the compressor manufacturer to the user, which provide the user with identification of the compressor's choke line. An exemplary plot of the characteristic curves of a compressor is provided in FIG. 4, showing surge and choke lines in addition to speed lines for 50-110% designed operation in 10% increments.

Thus, by determining the operation of the first compressor 12 relative to its choke line by measuring the measurement values of step (c), and controlling the throttling of the compressor in response to these measurements, the choking of the compressor can be avoided.

Returning to FIG. 1, the automatic control of the throttling valve 32 is based on non-user computation of the pressure and/or flow measurements described herein. Such control can be provided by the use of one or more automatic controllers known in the art, represented in FIG. 1 as a controller "XC", able to compute and compare the measurement values provided by step (c) in relation to one or more pre-determined values, and directly provide one or more control instructions to the throttling valve 32 so as to control the discharge pressure of the first compressor 12 depending on the nature and properties of the compressor feed stream 10.

Preferably, the presently disclosed method also comprises automatically controlling the in-line first recycle valve 24 in the compressor recycle line 22 for the same reason, optionally through the same controller(s) such as the controller XC shown in FIG. 1.

The presently disclosed method and apparatus is not limited by the form of measuring the pressure and/or flow measurement values, or to their nature or number. For instance, measuring the flow of the compressor feed stream or the first compressed stream is not limited to a direct stream flow measurement, such that any parameter from which the relevant stream flow can be derived may be used as the flow measurement value. Consequently, the actual measurement may be of a parameter which indirectly measures flow, such as the pressure change across an orifice, nozzle or venturi, which can then be used to calculate the flow of the compressor feed stream or first compressed stream. Such direct and indirect methods of measuring flow are known in the art. The flow measurement value can be used to determine the operation of the compressor in relation to its choke line.

A pressure value can be taken using any suitable pressure measurer such as P1 and P2 shown in FIG. 1, and a stream flow measurement can be provided by any suitable flow measurer such as F1 and F2 shown in FIG. 1. Although two flow measurers F1, F2 and two pressure measurers P1, P2 are shown in FIG. 1, the method disclosed herein can operate with a single flow measurer and a single pressure measurer. The additional flow and pressure measurers shown provide alternative possible locations for these devices, although the presence of more than one flow meter or pressure meter is included within the scope of this embodiment. The pressure and flow measurers P1, F1, P2, F2 and the controller XC are not shown in FIGS. 2 and 3 for clarity purposes only.

Preferably, step (c) of the presently disclosed method comprises measuring at least one of the group comprising:

(i) the pressure P1 and the flow F1 of the compressor feed stream 10;

(ii) the pressure P1 of the compressor feed stream 10 and the flow F2 of the first compressed stream 20;

(iii) the flow F1 of the compressor feed stream 10 and the pressure P2 of the first compressed stream 20; and (iv) the pressure P2 and the flow F2 of the first compressed stream 20.

A comparison of any of the above two values can provide to a computator a calculation of the operation of the first compressor 12 in relation to its choke line in a manner known in the art.

FIG. 1 shows the four measurement values P1, F1, P2 and F2 being passed along dashed signal paths to the controller XC, which computes the measurement values to calculate operation of the first compressor relative to its known choke line, and sends control signals to the throttling valve 32 and optionally the in-line first recycle valve 24 to control their operation, and hence the flows of the first recycle stream 22 and the first compressed continuing stream 25 (discussed below) to avoid choking of the first compressor 12.

A method of controlling the first compressor 12 for any compressor feed stream, especially for one or more hydrocarbons such as an ethane-containing stream, is disclosed herein.

The first compressor 12 has a first inlet 13 and first outlet 16 and is able to compress at least a fraction of the compressor feed stream 10 to provide a first compressed light stream 20 in a manner known in the art.

Between the first outlet 16 and first inlet 13 of the first compressor 12, there is the first compressor recycle line 22 which is able to take at least a fraction of the first compressed stream 20 and recycle it back into the path of the compressor feed stream 10. The first compressor recycle line 22 is added to compressor feed stream 10. The division of the first compressed stream 20 between a first compressed continuing stream 25 and a first compressor recycle stream 22 may be carried out by any suitable divider or stream splitter known in the art.

The division of the first compressed stream 20 may be anywhere between 0-100% for each of the continuing stream 25 and first recycle stream 22 as discussed further hereinafter.

The first compressor recycle line 22 is a dedicated line around the first compressor 12. The first compressor recycle line 22 is preferably uncooled, and thus preferably does not contain a cooler. More preferably the first compressor recycle line 22 only includes one or more control valves 24, required to change the pressure of the first compressor recycle stream 22 to approximate or equate its pressure to the intended pressure of the compressor feed stream 10 for the suction side of the first compressor 12.

Optionally, the first compressed line 20 providing the first compressed stream 20, includes one or more coolers, such as one or more water and/or air coolers, to reduce the temperature of at least the compressor recycle stream 22 prior to its re-introduction into the inlet 13 of the first compressor 12.

The first compressed continuing stream 25 then passes through the throttle control valve 32 to provide the controlled stream 30. FIGS. 2 and 3 show the option of passing the controlled stream 30 into the one or more second compressors 42, each second compressor 42 having a second inlet 43 for the controlled stream 30 and a second outlet 44, to provide a second compressed stream 40 in a manner known in the art. The or each second compressor 42 may be the same or similar to a 'boost' compressor, generally having a dedicated driver or drive mechanism separate from the first compressor 12.

Around the or each second compressor 42, more particularly between the second outlet 44 and second inlet 43 can be a second compressor recycle line 45, such that the one or more second compressed streams 40 can be divided by a divider or stream splitter known in the art, anywhere between 0-100%, between a final compressed stream 70 and a second compressor recycle stream 45. The final compressed stream 70 can contain a one-way valve 41. The second compressor recycle stream 45 includes one or more coolers 46, such as in-line coolers, preferably one or more water and/or air coolers, known in the art and adapted to reduce the temperature of the second compressor recycle stream 45. The one or more air coolers 46 are followed by one or more control valves 47 to provide a final recycle stream 48 for re-injection into the main compressor stream in advance of the second inlet 43 of the second compressor 42.

The second compressor recycle line 45 provides anti-surge control around the second compressor 42 in a manner known in the art. The second compressor recycle line 45 is a dedicated line around the second compressor 42. In particular, it is noted that the one or more coolers 46 are only required to cool the percentage of the second compressed stream 40 which is passed into the second compressor recycle line 42, which percentage is commonly zero or minimal, thus minimising the OPEX of the one or more coolers 46.

FIGS. 2 and 3 show a simplified arrangement of the recompression of a compressor feed stream 10 using a first compressor 12 which has a dedicated first compressor recycle line 22, (that may not require dedicated or external cooling), and a second compressor 22 with a dedicated second compressor recycle line 45. Thus, the first and second compressor recycle lines 22, 45 are independent, and can be independently controlled.

FIG. 1 also shows a first bypass line 60 with a one-way valve 62 around the first compressor 12 so as to be able to take a fraction of the compressor feed stream 10 around the or each first compressor 12 to provide controlled stream 30 which supplies the feed for the or each second compressor 42. The first bypass line 60 may be used during start-up of the NGL recovery system 1, especially where there is no driving power for first compressor 12, (for example where it is mechanically linked to and therefore driven by the expander 52). The first bypass line 60 may also be useful where one or more of the first compressors 12 'trips' as further discussed hereinafter.

Similarly, FIG. 2 shows an expander bypass line 80 around the expander 52 having a control valve 82. In this way, at least a fraction, optionally none or all, of a mixed hydrocarbon stream 8 can be selectively allowed to pass through the expander bypass line 80 to bypass the or each expander 52 and be fed into the mixed-phase hydrocarbon stream in line 9. This arrangement may occur during start-up of the NGL recovery system 1, and/or during tripping of one or more of the expanders 52 as further discussed hereinafter.

As shown in FIG. 3, the final compressed stream 70 may be wholly or partly used as fuel gas 72, or passed to gas network, or subsequently cooled, preferably liquefied, to provide a cooled hydrocarbon stream such as LNG. The cooling and preferred liquefaction may be carried out by passage along line 71 in the second cooling stage 112, typically comprising one or more heat exchangers, to provide a liquefied hydrocarbon stream 130. Suitable liquefaction processes for such second cooling stages are known to the person skilled in the art and will not be further described here.

FIG. 3 also shows an embodiment, wherein the expander 52 prior to the first gas/liquid separator 14 is mechanically-linked to the first compressor 12. Such mechanical-linking may occur by any known linkage, one example of which is a shared or common driveshaft 21. The mechanical linking of an expander and a compressor, in order to use some of the work energy provided from the expander by the expansion of a gas therethrough, to partly or fully drive a mechanically linked compressor, is known in the art.

In this way, operation and performance of the first compressor 12 can be related to the operation and performance of the expander 52 as discussed further hereinafter.

The method disclosed herein is particularly advantageous during the start-up of the first compressor 12. A first by-pass line 60 can be provided around the first compressor 12 to allow a fraction of the compressor feed stream 10 to bypass the first compressor 12 and the throttle valve 32. The pressure in lines 25 and 30 can thus be regulated.

In this way, especially during start-up of a hydrocarbon processing process or treatment, nearly all of the compressor feed stream 10, such as provided by a first gas/liquid separator 14, can pass through the first bypass line 60 so as to provide a flow downstream thereof, whilst the flow and/or pressure of the compressor feed stream 10 is increasing. The throttling valve 32 provides automatic control for the integration of the first compressor 12 with a line downstream, by controlling the pressure differential between the first bypass stream 60 and the increasing provision of the controlled stream 30 (based on the increasing fraction of the compressor feed stream 10 being passed into the first compressor 12 and through a one-way valve 31 thereafter). Operation of the throttling valve 32 allows integration of the compressor 12 to proceed in line with diminution of the first bypass stream 60, without affecting the pressure of the compressor feed stream 10 provided from a separator (such as the first gas/liquid separator 14 shown in FIG. 1).

It is a particular advantage of the method and apparatus disclosed herein that the controller XC can provide automatic control of the throttle valve 32 and/or the in-line recycle valve 24 during start-up of the compressor 12 and use of the first bypass line 60.

Thus, the presently disclosed method extends to a method of controlling the start-up of a first compressor 12 using a method of controlling the first compressor 12 as defined herein.

It is another particular advantage of the method and apparatus disclosed herein to provide control of the first compressor 12 as a consequence of any upstream pressure drop that affects the pressure of the compressor feed stream 10, including any sudden or dramatic drop in pressure of the source of the compressor feed stream 10, or a fraction thereof.

Figure 5:
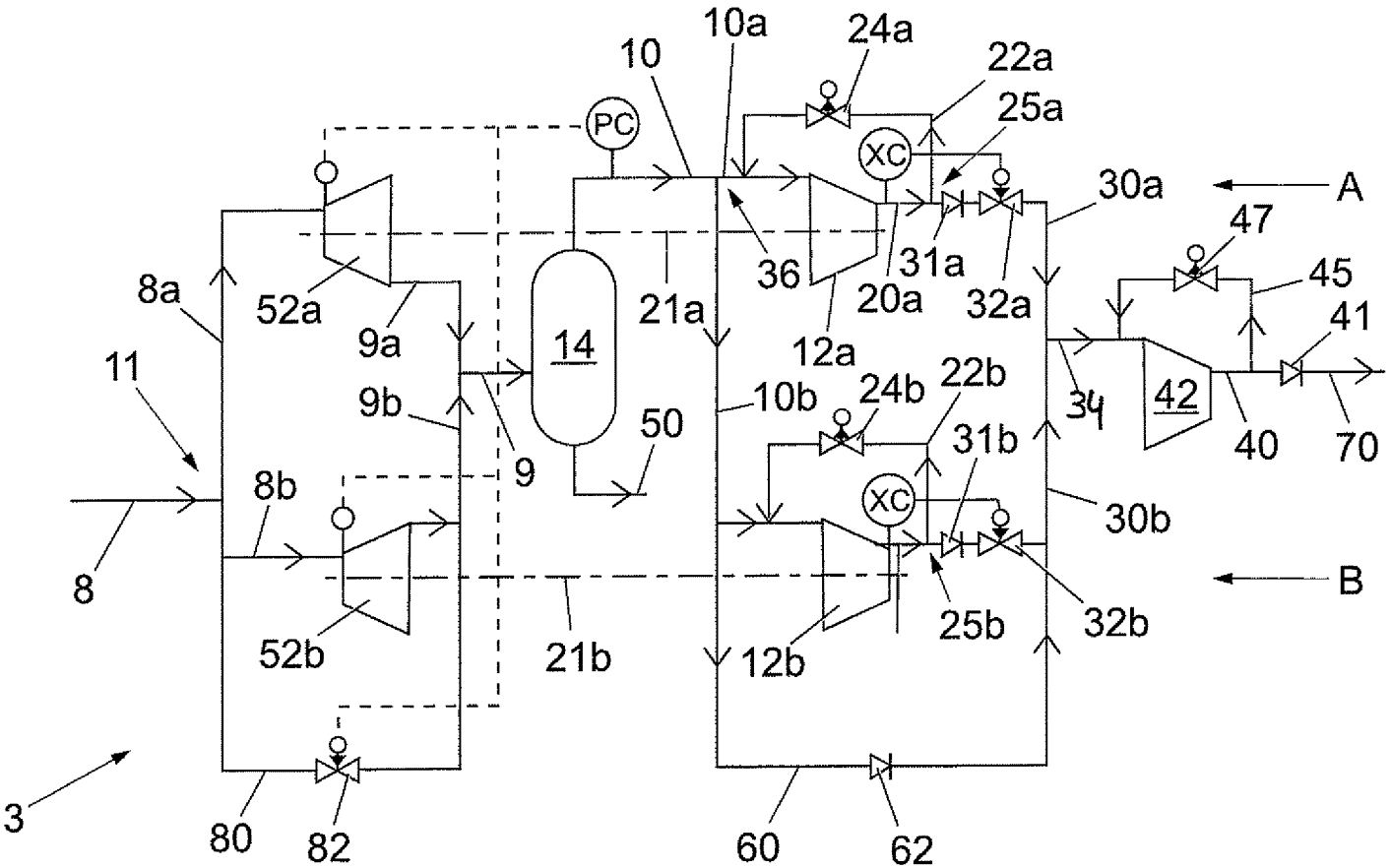
FIG. 5 is a diagrammatic scheme for a method of controlling two parallel compressors according to a third embodiment of the present invention.

An example of this is the 'tripping' of an associated or related process, apparatus, unit or device such as a mechanically interlinked expander-compressor string as described hereinafter. In particular, in a multi-stream NGL recovery system, an example of which is shown in FIG. 5, the tripping of one expander-first compressor string requires a usually rapid adjustment of the flow of various streams, including the compressor feed stream 10, through the NGL recovery system so as to maintain continuation of the process whilst the tripped string is re-integrated. Automatic control of a throttling valve 32 allows reintegration of a tripped string back into the main process by controlling the pressure downstream of the or each first compressor whilst full re-pressurisation of one or more compressor feed streams is ongoing.

FIG. 5 shows a simplified and second NGL recovery system 3 based on having a first expander and first compressor string A, and a second expander and first compressor string B.

In FIG. 5, a mixed hydrocarbon stream 8, such as that provided as shown in FIG. 3, is divided by a stream splitter 11 into at least two, preferably two or three, part-feed streams 8*a* and 8*b*, which pass into respective expanders 52*a* and 52*b* which are mechanically linked by respective common driveshafts 21*a* and 21*b* to respective first compressors 12*a* and 12*b*. The division of the mixed hydrocarbon stream 8 into the part-feed streams 8*a* and 8*b* may be any ratio or percentage, but will generally be equal during normal and conventional operation of the second NGL recovery system 3 wherein the expanders 52*a* and 52*b* have the same capacity. Variations in the size, type, capacity, number and their balance of the expanders 52*a*, 52*b*, and in consequence in the size, capacity, type, number and balance of the first compressors 12*a*, 12*b*, are known to the skilled man in the art with knowledge of NGL recovery processes, operations and parameters.

Each expander 52*a*, 52*b* provides a mixed-phase hydrocarbon stream 9*a*, 9*b* respectively, which can be combined by a suitable combiner such as a T-piece, to provide a single mixed-phase hydrocarbon stream 9 to pass into the first gas/liquid separator 14 as hereinabove described. Optionally, one or more of the mixed-phase hydrocarbon streams 9*a* and 9*b* may pass directly into the first gas/liquid separator 14 without combination with the or all of the other mixed-phase hydrocarbon streams.

The first gas/liquid separator 14 provides a light overhead stream, and a heavy bottom stream 50 as hereinbefore described. The light overhead stream can provide the compressor feed stream 10, which be divided by a stream splitter 36 in a manner known in the art to provide at least two, preferably two or three, part-compressor feed streams 10*a*, 10*b* which pass respectively into the two first compressors 12*a*, 12*b* through their first inlets to provide two respective first compressed streams 20*a*, 20*b*. 0-100% of the first compressed streams 20*a*, 20*b* may pass into two respective first compressor recycle lines 22*a*, 22*b* for recycle through respective control valves 24*a*, 24*b* and return to the suction sides of the two first compressors 12*a*, 12*b* as described hereinabove.

That fraction of each of the first compressed streams 20*a* and 20*b* not passing into the first compressor recycle lines 22*a*, 22*b* provide first compressed continuing streams 25*a*, 25*b* which can pass through respective one-way valves 31*a*, 31*b* and throttle control valves 32*a*, 32*b* to provide controlled streams 30*a*, 30*b* before being combined by a combiner 53 to provide a combined second compressor feed stream 34 which passes to a second compressor 42 to provide a second compressed stream 40. As described above, a fraction between 0-100% of the second compressed stream 40 can provide a second compressor recycle stream 45, which can contain one or more control valves 47, whilst a final compressed stream 70, which can be passed through one-way valve 41, can then be used as described above, for example as one or more of a fuel stream, export stream, or for cooling, preferably liquefying, to provide a liquefied hydrocarbon stream such as LNG.

The combination of the first expander 52*a*, the mechanically linked first compressor 12*a*, and their associated lines, provide the first string A, whilst the combination of the second expander 52*b*, the mechanically linked first compressor 12*b*, and their associated lines, provide the second string B.

In this way, the user of the second NGL recovery system 3 is able to have greater options and flexibility concerning the flow of the mixed hydrocarbon stream 8 through the second NGL recovery system 3, in particular operations and flows through the expanders 52*a*, 52*b* and first compressors 12*a*, 12*b*. As well as providing operational advantages during normal and/or conventional running of an NGL recovery system, this arrangement further provides two further advantages.

As discussed hereinbefore, should any string of a multi-string NGL recovery system not be able to run normally, either by accident or design, the continuance of the NGL recovery is possible through one or more of the other strings. In particular, where a string should 'trip', then the or each other string is able to continue operation of the NGL recovery, even if the volume and/or mass of the mixed hydrocarbon feed stream continues at the same level, or continues at a significant level.

The 'tripping' of an expander-compressor string can occur for a number of reasons, and/or in a number of situations. Common examples include 'overspeed', for instance where the driver produces more power than that required by the compressor and 'vibration' when the compressor is operating beyond the flow envelope and the flow angle with respect to the vane angle is incorrect.

A second particular advantage of the second NGL recovery system 3 shown in FIG. 5 is during start-up of the NGL recovery. By providing two or more strings, each string can be separately started at a different time, and optionally with different starting parameters than each other strings. Thus, the user has greater options and control over the start-up of all the strings prior to full and normal operation of the overall NGL recovery system 3.

As an example, at the start-up of an NGL recovery system, the mixed hydrocarbon feed stream 8 is usually passed through an expander bypass stream 80 to bypass the first expanders 52*a*, 52*b* to provide the mixed-phase hydrocarbon stream 9 because the pressure in the mixed hydrocarbon feed stream 8 may already be at a low level, such that expansion in first expanders 52*a*, 52*b* is unnecessary, or would result in too low a pressure in mixed-phase hydrocarbon stream 9. This provides a higher pressure compressor feed stream 10 to first compressors 12*a*, 12*b* than would otherwise occur.

Similarly, the compressor feed stream 10 can pass through the first bypass line 60, and one-way valve 62 to bypass the first compressors 12*a*, 12*b*, especially where these are not provided with power or otherwise driven by the first expanders 52*a* and 52*b* which are being similarly by-passed.

It is a particular advantage of the method and apparatus disclosed herein that through pressure and flow control of each bypass stream and each part-stream, as the flow and/or pressure of the mixed-phase hydrocarbon stream 9 increases during start-up, one or more strings of a multi-string NGL recovery system can be separately started and brought up to normal operation as a controlled procedure. Thus, the two throttle control valves 32*a*, 32*b* in the paths of the first compressor continuing streams 25*a*, 25*b*, allow control of the introduction of each compressor feed stream 10*a*, 10*b* into the first compressors 12*a*, 12*b* in calculation with reduction of the flow of the first bypass stream 60. The two throttle valves 32*a*, 32*b* can control the pressure at the discharge of each of the first compressors 12*a*, 12*b*, especially near stonewall of each first compressor 12*a*, 12*b*, which most usually can occur during start-up and following any tripping of a string.

In this way, the pressure of the stream in the first bypass line 60 does not hinder the start-up of each of the first compressors 12*a*, 12*b*, either together or independently. This arrangement seeks to ensure maximum forward flow through the or each first compressor, (and hence no overheating), without operating in the stonewall region.

It is a further advantage of a multi-string NGL recovery system that one or more of the first compressors 12*a*, 12*b* can be isolated from the or each other first compressors, so as to reduce interaction between the first compressors 12*a*, 12*b*.

A person skilled in the art will readily understand that the present invention may be modified in many ways without departing from the scope of the appended claims.

I claim:

1. A method of controlling one or more first compressors at least comprising the steps of:

(a) providing a compressor feed stream;

(b) passing the compressor feed stream through the one or more first compressors, the or each first compressor having a first inlet and a first outlet to provide one or more first compressed streams;

(c) measuring at least one pressure and at least one flow of the group consisting of: the pressure (P1) of the compressor feed stream, the flow (F1) of the compressor feed stream, the pressure (P2) of the first compressed stream and the flow (F2) of the first compressed stream, to provide at least two measurement values;

(d) providing a first compressor recycle line including an in-line first recycle valve around the or each first compressor;

(e) passing the or each first compressed stream through at least one throttling valve downstream of the compressor recycle line to provide a controlled stream;

(f) selectively allowing a fraction of the or each compressor feed stream to bypass the or each first compressor and the at least one throttling valve via a first bypass line; and (g) automatically controlling at least one of the throttling valve(s) using the measurement values of step (c), wherein the compressor feed stream is provided from a mixed hydrocarbon stream which is separated into a light overhead stream being the compressor feed stream, and a heavy bottom stream, wherein the mixed hydrocarbon stream is expanded in one or more expanders to provide a mixed phase hydrocarbon stream upstream of its separation, and at least one of the one or more expanders and at least one of the one or more first compressors are mechanically interconnected by one or more common drive shafts.

2. The method as claimed in claim 1 wherein the use of the measurements values of step (c) comprises determining the operation of the first compressor relative to its choke line.

3. The method as claimed in claim 1, further comprising the step of:

(h) automatically controlling the in-line first recycle valve using the measurements values of step (c).

4. The method as claimed in claim 3, wherein the use of the measurements values of step (c) comprises determining the operation of the first compressor relative to its surge line.

5. The method as claimed in claim 1, further comprising selectively combining a first bypass stream in the first bypass line with the controlled stream.

6. The method as claimed in claim 1, further comprising co-ordinating the measurements of step (c) and the control of step (f) using a controller (XC).

7. The method as claimed in claim 1, comprising measuring at least one of the group consisting of:

(i) the pressure (P1) and the flow (F1) of the compressor feed stream;

(ii) the pressure (P1) of the compressor feed stream and the flow (F2) of the first compressed stream;

(iii) the flow (F1) of the compressor feed stream and the pressure (P2) of the first compressed stream; and (iv) the pressure (P2) and the flow (F2) of the first compressed stream.

8. The method as claimed in claim 1, further comprising the steps of:

(j) passing the or each controlled stream through one or more second compressors to provide one or more second compressed streams; and (k) providing a second compressor recycle line, an in-line second recycle valve, and optionally including one or more second compressor recycle coolers.

9. The method as claimed in claim 8, further comprising liquefying at least a fraction of the one or more of the second compressed stream(s), to provide a liquefied hydrocarbon stream.

10. The method as claimed in claim 1, wherein:

the compressor feed stream is divided into two or more part-feed streams to pass through two or more first compressors to provide two or more first compressed streams to pass through two or more throttling valves to provide two or more controlled streams; and wherein the steps (b), (e), and (g) are carried out on each part-feed stream, each first compressed stream and each throttling valve.

11. The method as claimed in claim 10, wherein the two or more controlled streams are combined to provide a combined second compressor feed stream to pass through a second compressor.

12. The method as claimed in claim 1, comprising: dividing the mixed hydrocarbon stream into at least two part-streams; and wherein expanding the mixed hydrocarbon stream comprises expanding each of said part-streams through an expander and combining their outflows to provide the mixed-phase hydrocarbon stream.

13. Apparatus for controlling one or more first compressors, the apparatus at least comprising: one or more first compressors to compress a compressor feed stream between a first inlet and a first outlet in the or each first compressor to provide one or more first compressed streams; at least two measurers able to measure at least one pressure and at least one flow of the group consisting of: the pressure (P1) of the compressor feed stream, the flow (F1) of the compressor feed stream, the pressure (P2) of the first compressed stream and the flow (F2) of the first compressed stream; to provide at least two measurement values; a compressor recycle line including an in-line first recycle valve around the or each first compressor; at least one throttling valve downstream of the compressor recycle line to receive the or each first compressed stream to provide a controlled stream; a first bypass line to allow a fraction of the compressor feed stream to bypass the or each first compressor and the at least one throttling valve; and automatically controlling at least one of the throttling valves using the measurements values of step (c), wherein the compressor feed stream is provided from a mixed hydrocarbon stream which is separated into a light overhead stream being the compressor feed stream, and a heavy bottom stream, wherein the mixed hydrocarbon stream is expanded in one or more expanders to provide a mixed phase hydrocarbon stream upstream of its separation, and at least one of the one or more expanders and at least one of the one or more first compressors are mechanically interconnected by one or more common drive shafts.

14. A method of cooling an initial hydrocarbon stream, comprising at least the steps of:

(i) passing the initial hydrocarbon stream through a separator to provide a stabilized condensate stream and a mixed hydrocarbon stream;

(ii) separating the mixed hydrocarbon stream into a light overhead stream as a compressor feed stream, and a heavy bottom stream; and (iii) passing the compressor feed stream through at least one first compressor to provide a first compressed stream and subsequently through at least one throttling valve, and controlling the first compressor to provide a controlled stream;

(iv) passing the controlled stream through at least one second compressor to provide a second compressed stream; and (v) cooling at least a fraction of the second compressed stream to provide a cooled hydrocarbon stream, wherein said controlling of said first compressor to provide the controlled stream at least comprises:

(c) measuring at least one pressure and at least one flow of the group consisting of: the pressure (P1) of the compressor feed stream, the flow (F1) of the compressor feed stream, the pressure (P2) of the first compressed stream, and the flow (F2) of the first compressed stream, to provide at least two measurement values;

(d) providing a first compressor recycle line including an in-line first recycle valve around the first compressor;

(e) passing the first compressed stream through the at least one throttling valve downstream of the compressor recycle line to provide a controlled stream;

(f) selectively allowing a fraction of the compressor feed stream to bypass the first compressor and the at least one throttling valve via a first bypass line; and (g) automatically controlling at least one the throttling valve using the measurement values of step (c), wherein the mixed hydrocarbon stream is expanded in at least one expander to provide a mixed phase hydrocarbon stream upstream of its separation, and wherein the at least one expander and the at least one first compressor are mechanically interconnected by a common drive shaft.

15. The method as claimed in claim 14, wherein the use of the measurements values of step (c) comprises determining the operation of the first compressor relative to its choke line.

16. The method as claimed in claim 14, further comprising the step of:

(h) automatically controlling the in-line first recycle valve using the measurements values of step (c).

17. The method as claimed in claim 16, wherein the use of the measurements values of step (c) comprises determining the operation of the first compressor relative to its surge line.

18. The method as claimed in claim 14, wherein said cooling of said at least a fraction of the one or more second compressed streams comprises liquefying the at least the fraction of the one or more second compressed streams, and wherein the cooled hydrocarbon stream comprises a liquefied hydrocarbon stream.

* * * * *